US005199898A

United States Patent [19]

Wisner

[11] Patent Number: 5,199,898

[45] Date of Patent: Apr. 6, 1993

[54] EXTERNAL TERMINAL SHIELD

[75] Inventor: Ronald R. Wisner, Adrian, Mich.

[73] Assignee: Tecumseh Products Company, Tecumseh, Mich.

[21] Appl. No.: 763,918

[22] Filed: Sep. 23, 1991

[51] Int. Cl.[5] ..... H01R 13/62

[52] U.S. Cl. ..... 439/367; 439/685

[58] Field of Search ..... 439/685, 694, 367, 359, 439/911, 565

[56] References Cited

U.S. PATENT DOCUMENTS

| | | | |
|---|---|---|---|
| 2,016,708 | 10/1935 | Douglas | 173/328 |
| 2,483,007 | 9/1949 | Higham | 230/206 |
| 2,527,657 | 10/1950 | Rowledge et al. | |
| 2,590,559 | 3/1952 | Miller | 171/252 |
| 2,606,232 | 8/1952 | John | 439/723 |
| 3,016,511 | 1/1962 | Unger | 339/126 |
| 3,160,460 | 12/1964 | Wyzenbeek | 439/685 |
| 3,167,293 | 1/1965 | Stenger et al. | 248/309 |
| 3,419,207 | 12/1968 | Hintze | 230/58 |
| 3,476,308 | 11/1969 | Rundell et al. | 230/58 |
| 3,960,427 | 6/1976 | Piaget et al. | 339/39 |
| 4,109,992 | 8/1978 | Hughes et al. | 439/685 |
| 4,319,299 | 3/1982 | Woods et al. | 361/24 |
| 4,325,600 | 4/1982 | Nestor | 339/116 |
| 4,676,569 | 6/1987 | Lambert et al. | 439/133 |
| 4,677,255 | 6/1987 | Cumley | 174/87 |
| 4,782,244 | 11/1988 | Wakimoto | 307/116 |
| 4,966,559 | 10/1990 | Wisner | 439/685 |

*Primary Examiner*—Larry I. Schwartz
*Assistant Examiner*—Hien D. Vu
*Attorney, Agent, or Firm*—Baker & Daniels

[57] ABSTRACT

A hermetic compressor with an external terminal assembly shield including a cluster block, hermetic terminal assembly, and an enclosure covering both the cluster block and hermetic terminal, with electrical power supply wires leading out of the enclosure. A means for interlocking the cluster block with the enclosure is provided allowing disconnection of the cluster block from the hermetic terminal assembly when the enclosure is opened. The enclosure alternatively includes a protuberance urging the cluster block into sealing engagement with the hermetic terminal assembly. A disconnectable electrical connector is connected to supply wires leading from the cluster block to enable electrical connection to the hermetic terminal assembly to be broken without exposing the hermetic terminal assembly.

8 Claims, 4 Drawing Sheets

EXTERNAL TERMINAL SHIELD

BACKGROUND OF THE INVENTION

The present invention relates generally to hermetic compressors of the type having a hermetic housing wherein a hermetic terminal is provided for carrying electric current into the housing and, more particularly, to such a terminal having an external enclosure.

Terminal assemblies for hermetic compressors are well known in the art and generally comprise a cup-shaped metallic body member having a plurality of metallic conductor pins extending therethrough. The pins are generally glass sealed to the insulator body to prevent leakage to the atmosphere. A cluster block or female socket arrangement attaches to the hermetic terminal to provide electrical current through the hermetic terminal to the electric motor inside the housing.

A problem associated with electrical terminals for hermetic compressors is that during compressor operation a process known as electrophoresis may occur, whereby metallic particles present within the system migrate toward and deposit upon the hermetic terminal conducting pins and on the surface of the interior glass seal insulator. Also other phenomena may occur in the presence of carbonaceous contaminants within the housing. These particles and contaminants can accumulate to the extent that an electrically conductive path is formed between a pin and the compressor housing, i.e., a ground fault, or between respective pins, i.e., a short circuit, thereby resulting in terminal failure.

Another problem of hermetic terminals is that of service personnel being exposed to hermetic terminals while the terminals are subject to an electric current. This may produce injury in the event of terminal failure. During service, sometimes field technicians remove the terminal enclosure before disconnecting electrical power to the compressor.

Methods for preventing contact with the terminal and protecting against injury in the unlikely event of terminal failure are known and include providing an upwardly extending fence around the hermetic terminal. Such a wall generally comprises a formed piece of metal welded to the exterior wall of the pressure housing thereby leaving an access opening which must then be covered with a combination cover piece and retaining clip. Another protective cover design employs a cover member received on a threaded stud welded to the compressor housing in close proximity to the hermetic terminal and retained thereon by a threaded nut or the like.

A present method for testing the continuity of the internal compressor wiring may result in the protective cover being removed to enable an electrical connection to be made to the compressor terminals. This presents a possible hazard if there is current applied to the compressor when the cover is removed.

It is desired to provide an external terminal shield effective in interrupting electric current during servicing of the compressor and to enable continuity checks to be made with out removing the cover.

SUMMARY OF THE INVENTION

The present invention provides a external terminal shield for a hermetic compressor in which a terminal fence and fence cover interlock with a terminal cluster block, thereby causing disconnection of the cluster block from the hermetic terminal when the fence cover is removed thereby shutting off electric current to the hermetic terminal. The present invention also provides a structure to break the electrical connection between an electrical power supply and the hermetic terminal assembly covered hermetic terminal.

Specifically, in one form of the invention, the invention provides a fence cover with an attached flange which is interlocked into a groove in the cluster block. When the fence cover is detached from the fence, the cluster block is pulled away from the terminal, breaking the electrical connection.

An alternative embodiment of the present invention includes a fence cover having a protuberance along one side which is in engagement with the cluster block. The protuberance urges the cluster block to seal over the hermetic terminal thereby helping to seal against any refrigerant oil leakage.

One form of the present invention includes a quick disconnect connector in connection with the power supply wires. This connector allows power to be disconnected from the compressor without having to remove the terminal enclosure so that compressor electrical continuity may be checked without having to expose the hermetic terminal.

An advantage of the external terminal shield of the present invention is that by disconnecting the fence cover from the fence, disconnection of the electrical connection between the cluster block and hermetic terminal is accomplished. This prevents electrical current from being applied to the compressor through the cluster block when the hermetic terminal is uncovered during servicing of the compressor.

Another advantage of the external terminal shield of the present invention is that it assists in retaining material which may be expelled from a compressor housing upon the unlikely occurrence of terminal venting. By surrounding the terminal with an enclosure, safety for personnel in the area of the compressor is increased.

A further advantage of the external terminal shield of the present invention is that of enabling temporary electrical hook ups and testing by the compressor manufacturer and field service without exposing the hermetic terminal.

The invention, in one form thereof, provides a compressor with a hermetic housing and hermetic terminal, having an external terminal shield assembly. The assembly includes a cluster block having electrical connectors that are attached to the hermetic terminal and electric power supply wires that lead from the electrical connectors to a external power supply. The cluster block and hermetic terminal are covered by an enclosure through which the electrical power supply wires extend. The enclosure attached to the compressor has a means to open the enclosure to expose the cluster block and hermetic terminal. Between the cluster block and enclosure is an interlocking means interlocking the cluster block and enclosure. When the enclosure is opened, the cluster block is automatically electrically disconnected from the hermetic terminal.

In one aspect of the previously described form of the invention, the enclosure comprises a terminal fence attached to the compressor and encircling the hermetic terminal. The enclosure also comprises a removable fence cover attached to the fence over the hermetic terminal interlocking with the cluster block. The interlocking means comprises a flange on the fence cover which interlocks with a groove on the cluster block to provide direct attachment of the cluster block to the fence cover. The fence cover may be attached to the fence by nonreversible screws.

In accord with another aspect of the invention, a disconnectable electrical connector is electrically connected in series with the power supply wires in proximity and external to the enclosure. The connector is intermediate the ends of the power supply wires to disconnect the compressor from an electrical power source. Accordingly, continuity field testing may be performed without opening the enclosure when the electrical connector is disconnected.

In a further embodiment of the invention, the enclosure or fence cover may contain a protuberance that engages the cluster block encircling the hermetic terminal assembly into sealing engagement with the terminal. By attaching the enclosure or fence cover with nonreversible screws, access to the hermetic terminal is discouraged.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
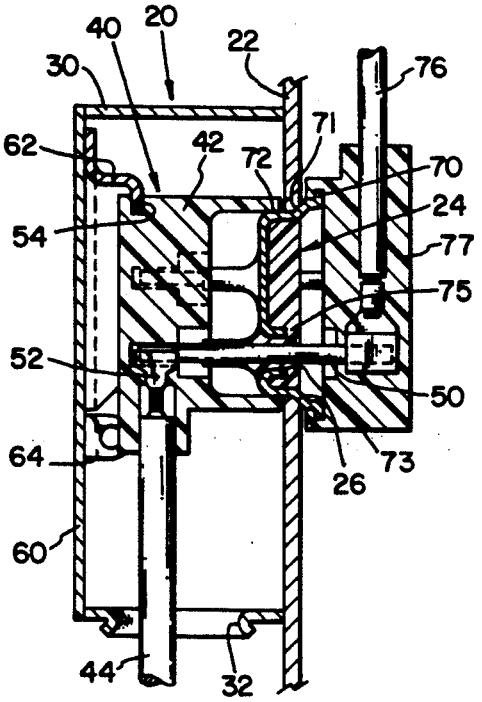
FIG. 1 is a longitudinal sectional view of the external terminal and shield assembly.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Referring now to FIG. 1, there is shown the external terminal shield 20 of the present invention attached to a housing sidewall 22 of a hermetic compressor of conventional design. External terminal shield 20 surrounds hermetic terminal assembly 24. Sidewall 22 includes an opening 26 into which hermetic terminal assembly 24 is welded.

Hermetic terminal assembly 24 is of known construction comprising a metallic, cup-shaped member 70 having a flange 71 and center portion 72, and openings 73. Flange 71 is disposed against the inner surface of opening 26 where terminal assembly 24 is welded into place. Metallic conductor terminal pins 50 are received and retained within each of the openings 73, and are sealed into openings 73 and electrically insulated from member 70 by a glass seal 75. Conductor pins are electrically connected to the compressor motor (not shown) by means of leads 76 and connector block 77.

External terminal shield 20 comprises a fence 30 welded to sidewall 22 around hermetic terminal assembly 24. Fence 30 has two openings 32 and 34 which power supply wires 44 extend through.

Figure 6:
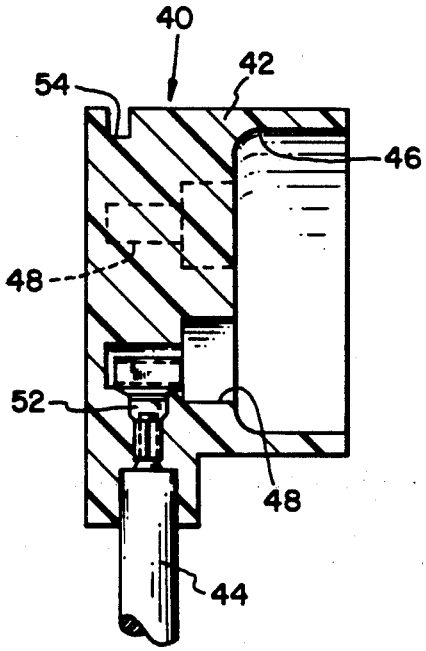
FIG. 6 is an enlarged longitudinal sectional view of the cluster block.
Figure 7:
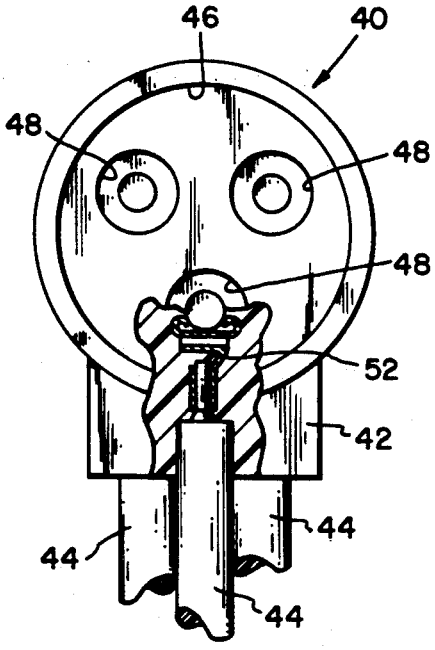
FIG. 7 is a view of the cluster block showing a cut away of an electrical socket.

As shown in FIGS. 6 and 7, conventional cluster block 40 includes an insulating cluster socket 42 preferably constructed from plastic with a plurality of power supply wires 44 attached. Cluster block 40 is preferably made of molded neoprene but other plastics may be used. On one side of cluster socket 42 is a recess 46 that is shaped to accept and engage portion 72 of hermetic terminal assembly 24. Covering and engagement of portion 72 by socket 42 seals hermetic terminal assembly 24 and may contain refrigerant within the compressor if hermetic terminal assembly 24 vents. Cluster socket 42 is removably attachable to hermetic terminal assembly 24. Within recess 46 are a plurality of blind bores 48 shaped to snugly engage hermetic terminal pins 50. Inside cluster socket 42, alongside each blind bore 48, is an electrical connector 52 which is attached to a wire 44. Electrical connectors 52 allow an electrical connection to be made between power supply wires 44 and hermetic terminal pins 50 when the cluster block 40 engages the hermetic terminal assembly 24.

Figure 2:
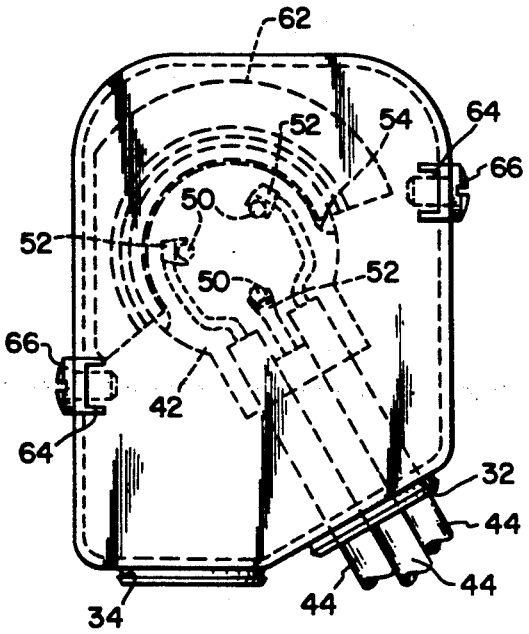
FIG. 2 is a plan view of the external terminal shield of the present invention shown with the cluster block in place
Figure 3:
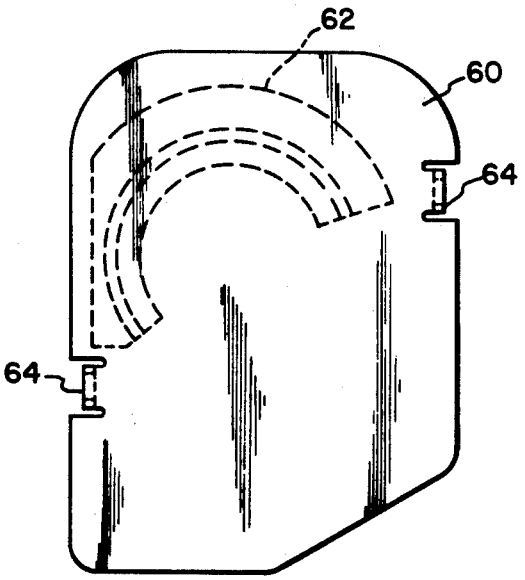
FIG. 3 is a plan view of the fence cover of the present invention.
Figure 4:
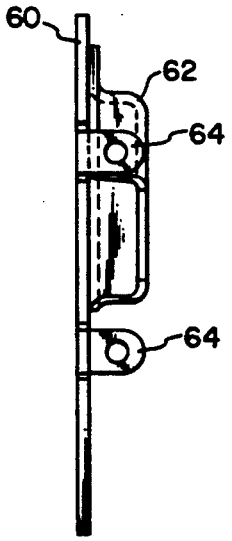
FIG. 4 is a side view of the fence cover of FIG. 3.
Figure 5:
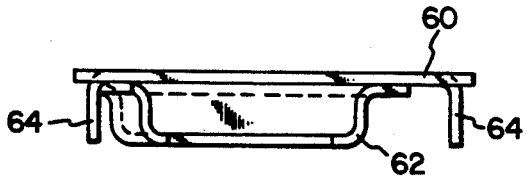
FIG. 5 is an end view of the fence cover of FIG. 3.

As shown in FIG. 1, cluster block 42 interlocks with external terminal shield or enclosure 20 comprising metal fence 30 and fence cover 60. More specifically, cluster socket 42 includes a groove 54 which can interlock with flange 62 on fence cover 60. Flange 62 is a substantially semi-circular flange which snap-fits into groove 54 of cluster block 40 thereby attaching the cluster block 40 to fence cover 60. Fence cover 60 includes attaching means such as right angle eyelets 64 for attaching fence cover 60 to fence 30. As shown in FIG. 2, cluster block 40 snap fits into flange 62 of fence cover 60. Fence cover 60 is then attached by means of screws 66 extending through fence 30 then into threaded right angle eyelets 64.

Figure 13:
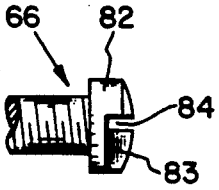
FIGS. 13 and 14 are a side view and end view respectively of a non-reversible screw.
Figure 14:
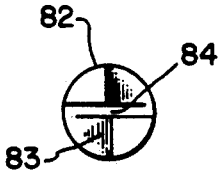
Figure 8:
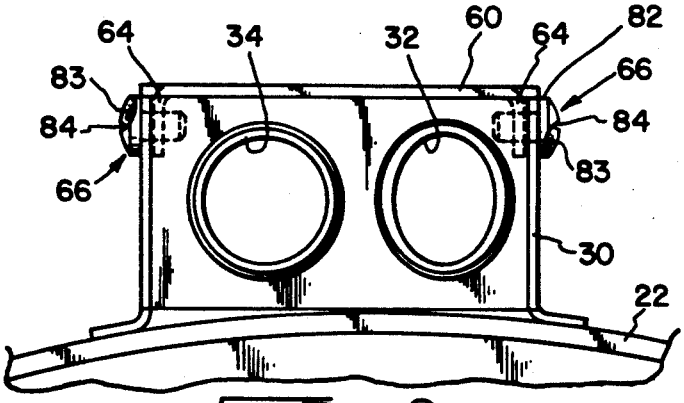
FIG. 8 is an end view of the external terminal shield of the present invention shown attached to the compressor housing.

Screws 66 may be of a conventional, non-reversible type in which the screw heads are formed to prevent a screwdriver from reverse driving the screw. FIGS. 13 and 14 show an example of a screw where the slot 84 of head 82 is open on a side 83 to prevent a screwdriver (not shown) from engaging and turning screw 66 in a reverse direction.

In operation, external terminal shield 20 covers hermetic terminal assembly 24 to contain refrigerant in the unlikely case of terminal venting. If fence cover 60 is opened, cluster block 40 will be pulled of electrical connection with terminal assembly 24 since block 40 is connected to fence cover 60.

Figure 10:
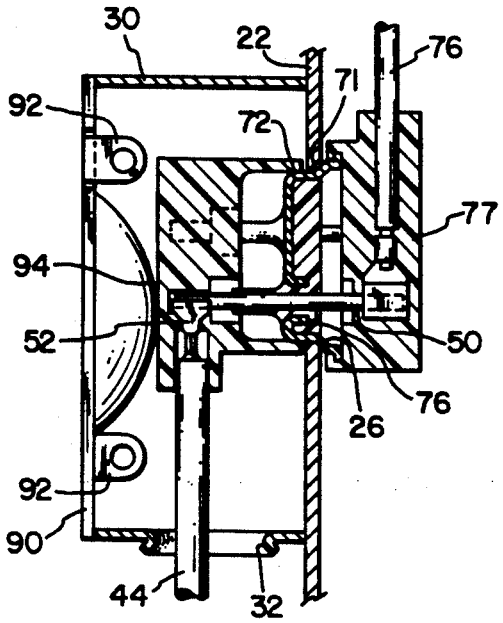
FIG. 10 is a side view of the alternate embodiment of the present invention employing the cover of FIG. 9.
Figure 9:
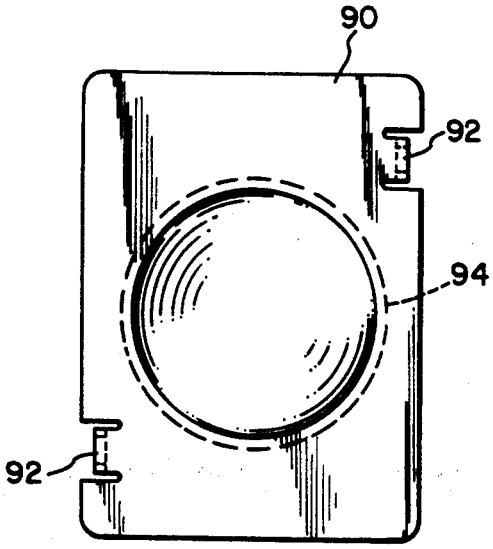
FIG. 9 is a plan view of an alternate cover.
Figure 11:
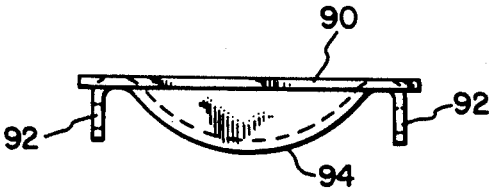
FIG. 11 is an end view of the cover of FIG. 9.

An alternate embodiment of the fence cover is illustrated in FIGS. 9–11. Similarly to cover 60, this alternative fence cover 90 includes attaching means such as right angle eyelets 92 to allow attachment to fence 30. The difference between fence cover 90 and fence cover 60 is that of a welded protuberance 94. When fence cover 90 is attached to fence 30 by means of screws 66, protuberance 94 presses cluster block 40 into electrical connection with hermetic terminal assembly 24. Protuberance 94 also urges cluster block 40 into sealing engagement with hermetic terminal assembly 24. As shown in FIG. 10, protuberance 94 urges cluster block 40 around hermetic terminal assembly 24. Recess 46 sealing around rim 72 helps contain compressor gases in case venting takes place.

Figure 12:
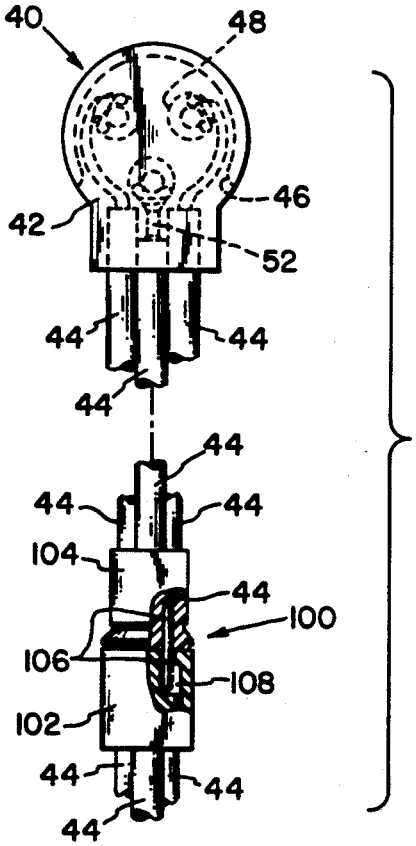
FIG. 12 is a sectional view of the cluster block showing a quick disconnect connector in series with the power supply wires.
Figure 15:
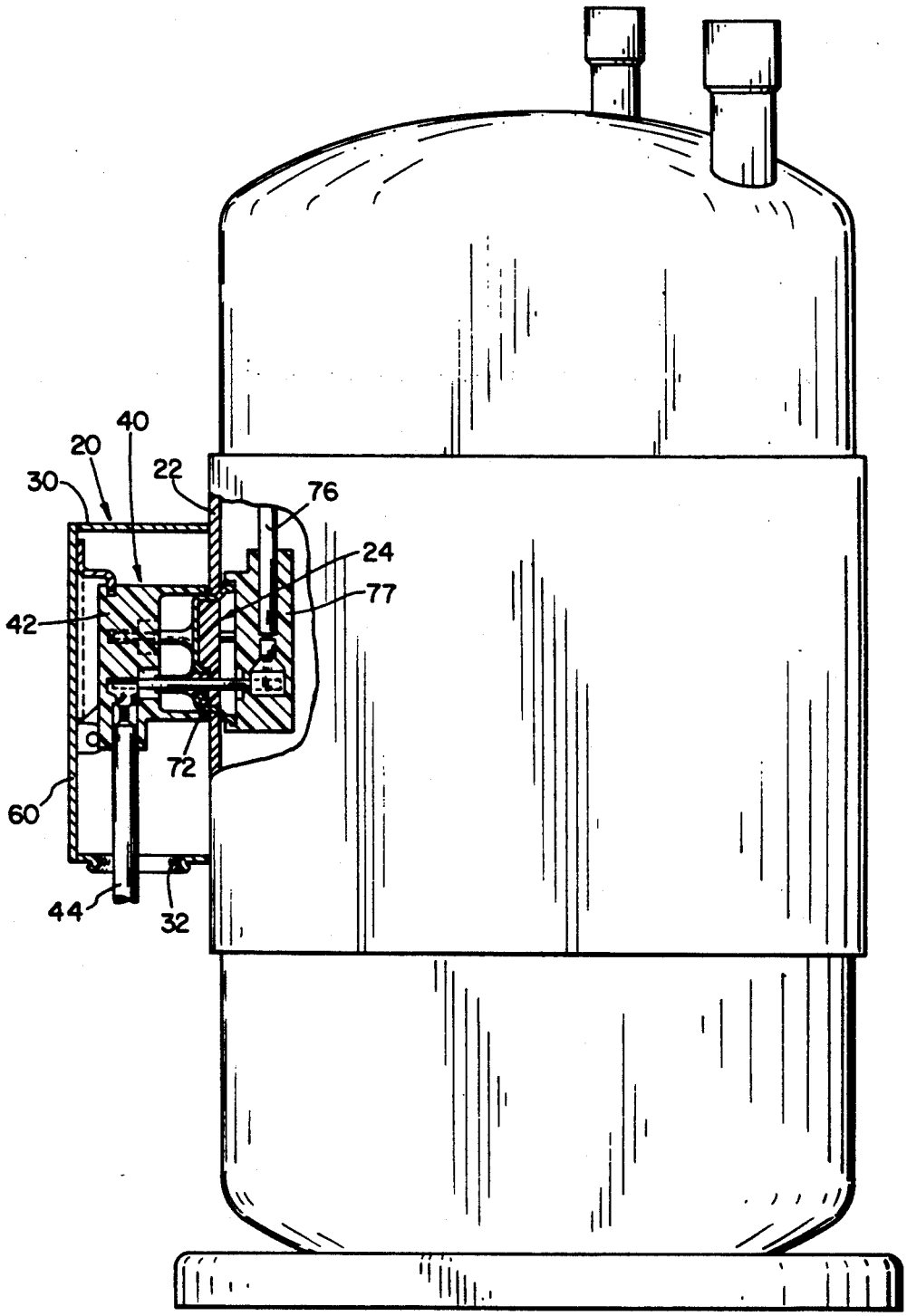
FIG. 15 is a sectional view of the terminal and shield assembly attached to a compressor having a hermetic housing.

FIG. 12 shows a cluster block with attached power supply wires in series with a quick disconnect connector 100. This connector 100 is of known construction an available from Lyall Electric Inc., with both a female line terminal 102 and a male line terminal 104. Male terminal 104 has a plurality of pins 106 that interfit with female connectors 108. Male terminal 104 may be separated from female terminal 102 by hand. Quick disconnect connector 100 allows field service personnel to quickly disconnect the compressor from its power source. Connector 100 also allows a field technician to interrupt the electrical power to the compressor without being exposed to an uncovered hermetic terminal assembly 24. With quick disconnect connector 100 separated, continuity testing of the internal compressor wiring may be accomplished by attaching testing equipment to male line terminal 104.

The quick disconnect may also alternatively be used in the embodiment of the external terminal shield shown in FIGS. 1–8.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A compressor with a hermetic housing and a hermetic terminal assembly thereon, said compressor having an external terminal shield assembly comprising:

a cluster block having electrical connectors removably attached to said hermetic terminal assembly, said cluster block including electrical power supply wires attached to said electrical connectors;

an enclosure covering both said cluster block and said hermetic terminal assembly, said electrical power supply wires leading from said cluster block through said enclosure to connect with an electric power source, said enclosure attached to said compressor and having means to open said enclosure to expose said cluster block and terminal assembly; and means for interlocking said cluster block with said enclosure, so that when said enclosure is opened said cluster block is automatically electrically disconnected from said hermetic terminal assembly.

2. The compressor of claim 1 in which said cluster block encircles and seals against said terminal assembly and said enclosure includes a protuberance that urges said cluster block into sealing engagement with said hermetic terminal assembly.

3. The compressor of claim 1 in which said enclosure comprises a terminal fence attached to said compressor, said fence encircling said hermetic terminal assembly, and a removable fence cover attached to said terminal fence over said hermetic terminal assembly, said cover being interlocked with said cluster block.

4. The compressor of claim 3 in which said fence cover is attached to said fence by non-reversible screws.

5. The compressor of claim 3 in which said means for interlocking comprises a flange on said fence cover to which said cluster block interlocks.

6. The compressor of claim 5 in which said means for interlocking further comprises said cluster block having a groove into which said flange interlocks to provide direct attachment of said cluster block to said fence cover.

7. The compressor of claim 1 further comprising a disconnectable electrical connector electrically connected in series with said wires in proximity and external to said enclosure, said connector being intermediate ends of said power supply wires to disconnect said compressor from said electrical power source, whereby continuity field tests may be performed without opening said enclosure.

8. The compressor of claim 7 in which said disconnectable electrical connector is a quick disconnect connector.

* * * * *